United States Patent [19]

Davis

[11] 4,275,040

[45] Jun. 23, 1981

[54] PROCESS FOR EXTRACTING TITANIUM VALUES FROM TITANIFEROUS BEARING MATERIAL

[75] Inventor: Brian R. Davis, Bricktown, N.J.

[73] Assignee: NL Industries, Inc., New York, N.Y.

[21] Appl. No.: 154,680

[22] Filed: May 30, 1980

[51] Int. Cl.[3] ..... C01G 23/00

[52] U.S. Cl. ..... 423/82; 75/1 T; 423/69; 423/DIG. 9

[58] Field of Search ..... 423/82, 83, 86, 69, 423/DIG. 9; 75/1 T

[56] References Cited

U.S. PATENT DOCUMENTS

| | | | |
|---|---|---|---|
| 1,338,473 | 4/1920 | Wrigley et al. | 423/83 |
| 1,504,669 | 8/1924 | Blumenfeld | 106/300 |
| 1,504,670 | 8/1924 | Blumenfeld | 423/85 |
| 1,504,671 | 8/1924 | Blumenfeld | 423/85 |
| 1,889,027 | 11/1932 | Washburn | 423/82 |
| 2,617,724 | 11/1952 | Espenschied | 423/82 |
| 2,982,613 | 5/1961 | Griffin | 423/82 |
| 3,071,439 | 1/1963 | Solomka | 423/85 |
| 3,615,204 | 10/1971 | Libera et al. | 423/85 |
| 3,647,414 | 3/1972 | Nilsen | 423/83 |
| 3,760,058 | 9/1973 | Langmesser et al. | 423/85 |
| 3,784,670 | 1/1974 | Yamada et al. | 423/82 |

OTHER PUBLICATIONS

Habashi, "Extractive Metallurgy", Gordon & Breach Science Pub., N.Y., 1970, vol. 2, pp. 15–17.

*Primary Examiner*—Herbert T. Carter

*Attorney, Agent, or Firm*—Gary M. Nath; Eugene Striffler

[57] ABSTRACT

Process of extracting titanium values from titaniferous bearing material by circulating a reaction mixture containing titanium values in an agitation column located within a reaction vessel in a direction countercurrent to the flow of the reaction mixture in the annular space located between the agitation column and the inner reaction vessel wall, said circulation being done in a manner to maintain the titaniferous bearing material in a continuous turbulent suspension flow in the agitation column and discharging the reaction mixture from the reaction vessel and recovering the extracted titanium values.

9 Claims, 2 Drawing Figures

PROCESS FOR EXTRACTING TITANIUM VALUES FROM TITANIFEROUS BEARING MATERIAL

The present invention relates to a method for extracting titanium values from titaniferous bearing material, and more particularly to an improved method for extracting by digesting or solubilizing titaniferous bearing materials in dilute sulfuric acid solutions.

Many methods have been proposed for extracting titanium values from titaniferous bearing materials. Among these include reacting the titaniferous materials with hydrochloric acid or sulfuric acid in various concentrations under a variety of conditions to solubilize the titanium and iron values. From a commercial standpoint, the most successful of these methods is a batch digestion process in which a titaniferous iron ore is reacted with concentrated sulfuric acid in a large digestion tank. Steam and/or water is then added to initiate and accelerate the reaction causing the temperature of the mixture to rise to its reaction temperature. At the reaction temperature, an extremely violent reaction occurs; the mixture boils releasing vast quantities of steam and vapor having entrained particulate matter and sulfur trioxide. As water is expelled, the entire mixture solidifies forming a so-called "digestion cake". This cake is then retained in the digestion tank for a number of hours while the reaction proceeds to completion in the solid phase. After curing, the dry cake is dissolved in water or weak acid to form a titanium sulfate and iron sulfate solution. The ferric sulfate values in the solution are converted to ferrous sulfate by the addition of a reducing agent, such as scrap iron. The solution is then clarified by settling and filtered to remove all of the solid material contained in the solution and the extracted titanium values recovered. Alternatively, the solution is further processed to prepare titanium dioxide and particularly titanium dioxide pigment.

When preparing titanium dioxide, the solution is then usually subjected to a crystallization step to remove most of the ferrous sulfate values a copperas, i.e., $FeSO_4.7H_2O$.

After crystallization, the titanium sulfate solution is concentrated by removing water from the solution. This is accomplished by evaporation in concentrators which operate under vacuum.

The concentrated titanium sulfate solution is then converted by hydrolysis, from the soluble state to form insoluble titanium dioxide hydrate. This change can be effected through dilution of the titanium sulfate solution with water at elevated temperatures or by addition of a nucleating agent with subsequent heating to the boiling temperature. During boiling, colloidal size hydrate particles initially precipitate, forming a filterable titanium dioxide hydrate. After separation, the titanium dioxide hydrate is usually subjected to a calcination treatment to remove water of hydration and provide anhydrous titanium dioxide pigment. The foregoing process is described in greater detail in, for example, U.S. Pat. Nos. 1,889,027, 2,982,613, 3,071,439, and 3,615,204.

Unfortunately, the batch type process suffers from a number of disadvantages. The reaction between the titaniferous bearing material and acid is limited to the utilization of certain high reaction temperatures and high acid concentrations. The process is also limited to the use of large size equipment resulting in a low rate of throughput. In addition, due to the extreme violence and exothermic nature of the batch digestion reaction, large quantities of steam and sulfur trioxide along with entrained particulate material are released into the environment creating undesirable environmental emission problems. Furthermore, a solid massive "digestion cake" is formed in the bottom of the digestion tank which is not only difficult, but slow to dissolve in an aqueous medium.

While the foregoing process represents what might be considered normal commercial practice, the literature contains references to a great many variations, reflecting the efforts of numerous investigators towards increased extraction, lower acid consumption, and other stepwise improvements in the efficiency and economy of the basic process. One prior investigator advocates a step-wise addition of acid to produce the dry cake, another heats to fusion, and yet another digests at a low temperature (100°-150° C.) for a long period of time. All of these methods have in common the formation of a massive sulfate digestion cake which must be dissolved in a large volume of water or dilute acid prior to effective extraction of titanium values.

Other methods, the so-called fluid processes, have been proposed which eliminate this solid phase by dissolving the ore directly with sulfuric acid at boiling temperatures and maintaining a sufficient water content in the system to insure fluidity of the reaction slurry. However, these processes have certain definite limitations and handicaps which cannot be eliminated. These processes are fluid state batchwise reactions which have the same economic deficiencies of the batch process discussed above. In addition, the reactions must be carried out at boiling which require the use of large amounts of costly fuel in order to maintain the proper digestion temperature. Furthermore, the final solutions are hydrolytically unstable, i.e., the titanyl sulfate converts to titanium dioxide hydrate very quickly upon standing. The presence of the titanium dioxide hydrate in the titanyl sulfate solution results in an uncontrolled hydrolysis reaction which prevents proper nucleation and precludes production of a high quality titanium dioxide pigment.

In digestion processes involving the solubilization of titanium values by sulfuric acid, a good dispersion of the titaniferous bearing material in the acid is essential for high recoveries of titanium. This is even more important in a continuous digestion system because when the ore settles out it will continue to react and solidify, thereby plugging up the system and disturbing the reaction equilibrium. In some prior art techniques, the titaniferous materials were suspended by steam or air fed into the bottom of the reactor. This method of agitation is generally known as a free gas-lift. Agitation in the reaction vessel by mechanical means was avoided because the digestion slurry solidified. Additionally, the corrosive and abrasive nature of the slurry and the intrinsic difficulty in avoiding dead spaces in large scale mechanically agitated reactors, i.e., areas in the reactor without turbulent motion, disfavors mechanical agitation. In a fluid suspension process free gas-lift agitation inherently fails to provide a good dispersion. Characteristically, free gas-lift agitation inherently fails to provide a good dispersion. In free gas-lift agitation the concentration of rising pulp increases steadily from zero at the bottom to very large at the surface.

The present invention provides a novel method for extracting titanium values from titaniferous bearing materials that substantially avoids or eliminates the prior art deficiencies encountered when extracting the titanium values. As used herein, the term titanium sulphate is used collectively to mean sulphate salts of titanium, such as titanyl sulphate and titanous sulphate.

According to the present invention, there is provided a process of extracting titanium values from titaniferous bearing material, which comprises:

(1) preparing a reaction mixture containing a titaniferous bearing material in an amount between about 10% and about 400% above the stoichiometric amount of titaniferous bearing material necessary to react with sulfuric acid to provide titanyl sulfate, and a dilute sulfuric acid solution having a concentration between about 25% and about 60% by weight;

(2) maintaining the temperature of the reaction mixture below about 140° C. in the reaction vessel;

(3) extracting the titanium values by circulating the reaction mixture in an agitation column located within the reaction vessel in a direction countercurrent to the flow of the reaction mixture in the annular space located between the agitation column and the inner reaction vessel wall, said circulation being done in a manner to maintain the titaniferous bearing material in a continuous turbulent suspension flow in the agitation column;

(4) cooling the resulting reaction mixture to a temperature below about 110° C. without precipitating the reaction mixture; and (5) discharging the reaction mixture from the reaction vessel and recovering the extracted titanium values.

In a preferred embodiment, the process of the present invention comprises:

(1) continuously reacting a titaniferous bearing material in an amount between about 10% and about 400% above the stoichiometric amount of material necessary to react with sulfuric acid to provide titanyl sulphate, and a dilute sulfuric acid solution having a concentration between about 25% and about 60% by weight;

(2) while maintaining the reaction mixture at a temperature below about 140° C. in the reaction vessel;

(3) extracting the titanium values by circulation through an agitation column located within the reaction vessel in a direction countercurrent to the flow of the reaction mixture in the annular space located between the agitation column and the inner reaction vessel wall, said circulation being done in a manner to maintain the titaniferous bearing material in a continuous turbulent suspension flow in the agitation column;

(4) cooling the resulting reaction mixture to a temperature below about 110° C. without precipitating the reaction mixture, and (5) continuously discharging the reaction mixture from the reaction vessel and recovering extracted titanium values.

Figure 1:
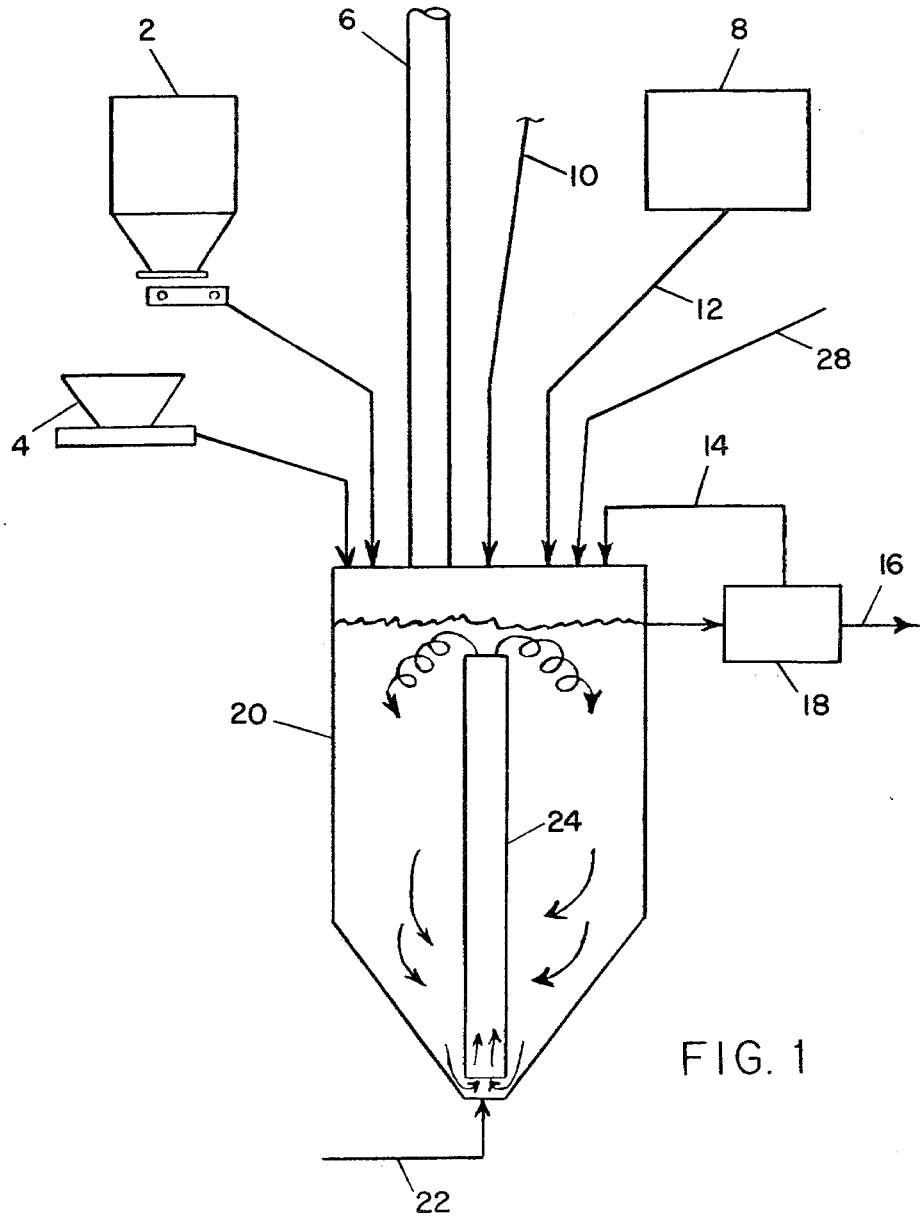
FIG. 1 depicts one embodiment of the process of the invention for carrying out the extraction of titanium values by the digestion of titaniferous bearing materials and recovering the extracted titanium as a titanium sulfate-iron sulfate solution wherein a stream of gas is employed with an agitation column to provide the desirable degree of extraction.

In order to insure optimum extraction of the titanium values by conversion during digestion to water soluble sulfates, the reaction of the titaniferous bearing material is performed with a dilute acid solution in a manner which avoids the formation of a digestion cake in the reactor, even after the reaction has run to completion. By preventing the formation of a digestion cake, it has been unexpectedly discovered that the reaction may be expedited by performing the reaction with a reaction vessel fitted with an agitation column which is capable of maintaining the reaction mixture in a continuous, turbulent suspension flow pattern. This agitation motion enhances the extraction of the titanium values.

The extraction of titanium values is achieved by digestion of a titaniferous bearing material which is reacted in a completely liquid phase without the need for a separate reduction step with dilute sulfuric acid to provide a stable hydrolyzable titanium sulphate solution which may be used for making titanium compounds and titanium dioxide pigments. As used herein, the term titaniferous bearing material means a material containing recoverable titanium values when treated according to the process of the invention. Exemplary materials include titaniferous slag, furnace slag, ilmenite ores such as magnetic ilmenite and massive ilmenite and ilmenite sands.

The digestion reaction is conducted with a sufficient amount of the titaniferous bearing material to provide an excess of said material in an amount between about 10% and about 400% above the stoichiometric amount. This amount may also be represented as being 1.1 to 5 times the stoichiometric amount. The following formula depicts the stoichiometry of the digestion reaction:

$$FeTiO_3 + 2H_2SO_4 \rightarrow TiOSO_4 + FeSO_4 + 2H_2O$$

The use of excess titaniferous bearing material in the digestion reaction is effective and desirable for achieving a successful and workable process according to the present invention without the need for excessive grinding of the ore. The titaniferous bearing material preferably has a surface area ranging between about 0.05 $m^2/cc$ to about 0.6 $m^2/cc$. Ore having a higher surface area could be used but provides no advantage because of increased grinding costs. As indicated hereinabove, an excess of titaniferous bearing material between about 10% and about 400% above the stoichiometric amount necessary for reacting with sulfuric acid should be employed in the digestion reaction of the process. The use of lesser amounts of results in unacceptably low reaction rates and long processing times so that the process becomes economically unattractive. Using amounts of excess material higher than recommended in undesirable due to greatly reduced fluidity of the reaction mixture and the need to recycle large quantities of unreacted titaniferous bearing material to the digestion reactors. It has been unexpectedly observed, for example, that doubling the amount of titaniferous bearing material such as MacIntyre ore above the stoichiometric amount for reacting with dilute sulfuric acid increases the rate of reaction in the order of at least 10 times in the last digestor. It should be recognized that reaction rates will vary with the source of titaniferous bearing material employed during digestion.

The sulfuric acid utilized in the process of the invention should have a concentration of between about 25% and about 60% by weight, based upon the total weight of the acid solution. An acid concentration below about 25% by weight is not desirable because hydrolysis of the titanium dioxide occurs during and in conjunction with the digestion reaction when using such acids. Premature hydrolysis of titanium salt solutions precludes the formation of pigment grade titanium dioxide at later processing stages. Also, utilizing an acid having a concentration greater than about 60% by weight is not desirable because the resulting reaction solution is more viscous and difficult to handle. In addition, the higher concentration of reaction products in solution promotes the precipitation of ferrous sulphate and recoverable titanyl sulphate dihydrate. The presence of ferrous sulphate monohydrate makes gravity separation ineffective and is difficult to remove by filtration.

The process operating conditions for conducting the digestion reaction may readily be adjusted, depending upon the concentration of the dilute sulfuric acid, the specific amount of excess titaniferous bearing material that is employed, and the extent and type of agitation employed to provide optimum process operation. To illustrate, utilizing dilute sulfuric acid of low concentration, e.g., below 40% by weight, initially requires operating the process at a lower temperature of the preferred temperature range because of the lower boiling point of the dilute sulfuric acid. As the digestion reaction progresses, it is desirable to increase the amount of titaniferous bearing material employed so as to digest as much material as possible in the first digestor reactor at which point the operating temperature and reaction rate are usually higher. As noted hereinbelow, the temperature in subsequent digestor reactors is maintained at a level lower than the first digestor reactor and, ultimately, must be reduced to preclude or avoid premature hydrolysis of the titanium salt solution.

The temperature at which the digestion reaction occurs is below about 140° C. and preferably between about 55° C. and the boiling point of the reaction solution, i.e., between about 55° C. and about 140° C. Selecting a temperature that is too low in a digestion reaction should be avoided because the digestion reaction will proceed too slowly and thus require increased residence time of the reactants in the digestion reactor. Also, increased residence times should be avoided to preclude the risk of undesirable nuclei formation in the reaction solution due to premature hydrolysis of the titanium salt. Selecting a temperature above 140° C. is not recommended because the titanium salt hydrolyzes at much faster rates at higher temperatures. Operating the digestion reaction below about 55° C. should be avoided because the reaction products begin to precipitate from solution and the viscosity of the reaction mixture increases, making removal of unreacted solids very difficult. A preferred operating temperature for conducting the digestion reaction is between about 70° C. and 110° C. It should be noted that the digestion reaction of the process of the present invention may be accomplished as a batch reaction, e.g., in a reaction vessel from which the reaction mixture, after the digestion reaction has proceeded to a desired extent, is withdrawn and processed further in other vessels. A preferred embodiment of the process of the invention is where the digestion reaction is performed continuously in at least two reaction vessels and wherein the titaniferous bearing material and the dilute sulfuric acid are made to flow concurrently.

When conducted in a continuous manner, the process is preferably performed using two or more digestor reactors. The total number of digestors being dependent upon the ease of reaction control, plant output and process handling.

The preferred operating temperatures for conducting the digestion reaction in two digestor reactors or stages are wherein the first digestor is maintained below about 140° C. preferably below about 110° C. and the second digestor is maintained below about 110° C., preferably below about 75° C.

Digestor temperatures may be varied depending upon the desired yield and reaction times present in each stage. One of the essential and salient features of the invention is that the temperature of the digestion reaction is decreased as the reaction progresses to preclude or avoid premature hydrolysis of the resulting titanium salt solutions. Premature hydrolysis of the titanium salt solution hinders the extraction of the titanium values.

The duration of the digestion reaction in a digestor is controlled by the optimum degree of conversion or digestion of the titaniferous bearing material at that stage. Generally speaking, it is preferred to digest or react as much of the titaniferous bearing material as is possible in the first digestor reactor or stage where the temperature is maintained at the highest level to preclude hydrolysis of the titanium sulfate in solution. For example, in a continuous multiple stage system employing MacIntyre ore as the source of titaniferous bearing material it is sometimes possible to digest in the first stage up to about 90% by weight of the stoichiometric amount of the ore charged to the process, excluding the excess ore. Preferably, between about 30% and 80% and most preferably between about 60% and 80% by weight of the stoichiometric amount of the ore is digested in the first stage, excluding the excess ore.

Temperature is used to control the digestion reaction preferably by monitoring the ratio of active acid to titanium in the reaction solution. This ratio is an indication of the degree of conversion or digestion. The term "active acid" means the total quantity of free acid in the reaction solution plus the acid combined with the titanium in the reaction solution. The ratio of active acid to titanium dioxide (active acid:titanium dioxide) is calculated as the sum of both the free acid in solution plus the acid combined with the titanium in solution divided by the titanium in solution (calculated as $TiO_2$). For example, the active acid content of a solution may be determined by titration of a selected sample (by weighing or pipeting techniques) with a 0.5 N caustic solution (NaOH) to a pH of 4.0 in a barium chloride/ammonium chloride buffered solution. The titration yields the content of free acid plus the acid combined with the $TiO_2$ which is referred to as active acid.

In a batch process, the active acid content can vary widely and is not critical except to the extent that digestion and reduction occur in a liquid phase. In a continuous process, the active acid ratio is permitted to drop from infinity at the commencement of the reaction to between 1.50 and 7.0 at the completion of the reaction dependent upon digestion conditions. Typically, the active acid to $TiO_2$ level varies between 2.0 and 3.5. As the active acid level decreases, the stability of the titanyl solution to hydrolysis decreases. Generally, the temperature of the reaction solution should be maintained below about 140° C. and preferably below about 110° C. as the ratio of active acid to titanium (calculated as titanium dioxide) falls to about 2.0. To illustrate in a two-stage digestion process, the temperature of the reaction solution in the first stage or digestor of the digestion reaction should be maintained at a temperature below about 140° C., e.g., 110° C., until the ratio of active acid to titanium dioxide of the reaction solution falls to about 3.0, at which time the temperature of the reaction solution is reduced to below about 110° C., e.g., 75° C. and continued to proceed until the active acid to titanium dioxide reaches about 2.0. In contrast, in a three stage digestion process, wherein the temperature of the first stage is maintained at about 110° C. to provide a reaction mixture having a ratio of active acid to titanium dioxide in the reaction solution in the range of between about 2.5 and about 3.0, and thereafter the reaction is conducted in a second stage at a temperature of about 100° C. to provide a reaction mixture having a ratio of active acid to titanium dioxide in the reaction solution in the range between about 2.2 and about 2.5. The reaction can then be completed in a third stage at a temperature below about 80° C. to provide a reaction mixture having a ratio of active acid to titanium dioxide in the reaction solution of about 2.0.

Each reaction vessel should be equipped with a suitable agitation means in order to maintain the titaniferous bearing materials in suspension.

The reaction vessel is formed of or lined with material adapted to resist the corrosive and abrasive effects of the reaction mixture. The dimensions of the reaction vessel can be determined readily having regard to the amount of titaniferous bearing material to be treated within a prescribed period, the degree of agitation desired, and degree of circulation desired. The ratio of the height and diameter of the tower are functions of the specific properties of the material to be treated and the reaction to be performed. As the diameter and the height of the reactor are increased to treat larger volumes of feed material, greater gas pressures or mechanical agitators are required to maintain the reaction mixture in suspension and to obtain the desired degree of agitation necessary to achieve optimum titanium extraction. It has been found that satisfactory results are obtained with reactors having a ratio of diameter to height within the range of from 1:1 to 10.

In order to provide sufficient dispersion and agitation of the reaction mixture, the reaction vessel is preferably designed to have a conically shaped bottom. The included angle of the cone should be sufficient to prevent deposition of reaction solids on the inclined walls of the cone. The conical bottom is intended to direct settled solids by gravity into the apex of the cone from where they may be passed to the top of the reactor by passage through the agitation column.

The reaction vessel is fitted with an agitation column such as a centrally located vertical tube which extends minimally from the apex of the reaction vessel bottom cone to above the top of the conically shaped bottom reactor section.

The length of the agitation column is critical to the extent that free-air lift outside the column is curtailed. In reactors having a full length column, the energy transferred from the gas is used to produce entrance, friction and velocity zones associated with the solution flow in the column. In contrast, columns extending only partially within the reactor have energies similar to those in a full column for the length of the column. The behavior above the column, however, is similar to that of the free-airlift reactor. In a free-airlift system, the solution is raised to flow from the bottom to across the top and the sides from the release area. Release is not a steady phenomenon, but rather the release wanders at random. Useful flow, however, is curtailed and energy efficiency lost due to nonuseful movement resulting from bubble slippage and horizontal movement of solution into the release area from the surrounding solution.

The length of the agitation column may vary widely but preferably extends at least the full depth of the reaction vessel. The agitation column may be supported on the vessel bottom or suspended above the vessel bottom. Provision must be made, however, for movement of the reaction mixture into the bottom of the agitation column. For example, slots or some comparable method may be employed to furnish entry at the bottom of the agitation column. The bottom entry way should minimally provide an opening area equal to the column cross sectional area to permit effective movement of the reaction mixture within the agitation column.

While it is preferred to have the gas inlet arrangement located at the bottom of the agitation column, other arrangements may be made. It should be recognized that the kinetic energy of the entering gas stream is normally small and therefore it contributes only a negligible amount to circulation when directed upward. Downward or horizontal injection can have benefits in distributing the gas across a large agitation tube if one is employed.

Agitation within the column is achieved using a stream of gas, mechanical agitator or combination of both. The gas stream used in the invention may be air, oxygen, enriched air or oxygen, an inert gas and mixtures thereof as the agitating medium. When extracting titanium values from ilmenite material as the source of titaniferous bearing material, an inert gas is preferred at temperatures below about 100° C. as the agitating medium, whereas at higher temperatures air is acceptable. When using ilmenite ore, the use of oxygen at lower temperatures should be limited since its solubility increases and thus acts at least in part as an oxidizing agent deleteriously converting ferrous sulfate to ferric sulfate. With slag, however, use of oxygen is preferable over the use of air or inert gas. The agitation column acts as a conduit to control and assure vertical flow and distribution of solid reactants. When agitation is initiated by introducing a stream of gas, introduction may be made into the bottom of the reaction vessel and preferably at the apex of the cone. While the gas is passing upwards through the reaction mixture, the gas expands in the agitation column from a higher to a lower pressure. When a proper gas release arrangement is employed, most of the energy will appear in a large-scale turbulent fluid current or flow carrying material from one place to another in the vessel. The agitation column directs this flow by providing an upward vertical flow of reaction mixture for its length with return of reaction solids by gravity in the annular space between the agitation column and the inner reaction vessel wall.

A sufficient amount of gas is used to insure suspension of unreacted solids and maximum ore to acid contact. In this manner, the stream of gas and reaction mixture flow concurrently within the agitation column resulting in a continuously rising turbulent suspension of gas bubbles and reaction mixture in which the reaction constituents are in their maximum concentration in the lower part of the reaction vessel. In this regard, large bubbles are undesirable in the column since they have a high slip or rising velocity relative to smaller ones. The gas inlet, should therefore, be sized to produce a high injection velocity to result in high shear forces and produce small bubbles.

It is not necessary to add the gas at the bottom of the agitation tube. In some cases, the ability to add the gas at other than the bottom has distinct advantages. For example, where vessels of various heights are used and the propelling media is a gas stream, power economies may be obtained by addition of the stream of gas above the vessel bottom. A savings is obtained because the gas does not need to be compressed to the higher pressure required for agitation in the deepest part of the reaction vessel when the gas is added at the bottom since addition of the gas to the agitation column above the bottom requires less pressure.

Alternatively, the flow in the agitation column may be provided by a mechanical agitator suspended within the agitation tube. The location of the mechanical agitator is not critical except to the extent necessary to provide a continuous, turbulent, suspension flow of reaction mixture through the agitation column. The agitator mechanism may be operated in any conventional manner to permit either upward or downward flow within the column depending upon reactor design, with upward flow being preferred.

The reaction vessel is preferably operated by feeding into the upper part of an unobstructed reactor the reaction mixture either as a premixed slurry or as titaniferous bearing material and dilute acid and directing the agitation means so that the reaction mixture flows in a turbulently suspensioned manner from the bottom to the top of the agitation column at which point the mixture is permitted to overflow and disperse within the reaction mixture located in the reaction vessel. As a result of this upward movement of fluid within the agitation column, the reaction fluid located between the agitator and reaction vessel wall is forced to move in a downward direction and eventually passed upward through the agitation column. While best extraction results are obtained by conducting the reaction in this manner other flow patterns may be employed even though not preferred.

The rate at which the mixture of gas bubbles and reaction mixture or reaction mixture alone when using mechanical agitator means, rise upwardly through the agitation column will vary dependent upon the extent of extraction desired. If the extraction stage is not completed in a single reactor, the reaction mixture can be passed to other reactors in sequence which reactors may optionally be equipped with agitation columns. The presence of agitation columns in multiple reactors, however, is not essential.

Materials of construction of the agitation column are not critical except to the extent that they must be constructed of a material which resists corrosion by the process reactants, especially the dilute sulfuric acid. Mechanical agitators used for agitation should be designed to resist wear and corrosion by the process reactants and ore particles.

The extraction process may be conducted in a reaction vessel fitted with more than one agitation column. While a reaction vessel having a single agitation column is preferred because of the difficulty in fabricating a digestor tank for more than one agitation column of the preferred design, it is contemplated to be within the scope of the invention to employ a plurality of such columns.

A suitable reductant such as, for example, iron or titanous sulphate may be added to the reaction vessel for the purpose of reducing trivalent ferric iron in the reaction mixture to divalent ferrous iron to preclude contamination of later obtained titanium hydrate with ferric salts.

The quantity of reductant used is chosen so that not only all of the trivalent iron in the titaniferous bearing material is converted to the divalent stage, but also part of the titanium in the reaction solution is reduced to the trivalent state in order to obtain a titanium sulphate solution for the hydrolysis step when preparing titanium dioxide that contains sufficient trivalent titanium. The presence of trivalent titanium reduces the formation of ferric iron which would adsorb on the titanium dioxide particles in the subsequent hydrolysis step of the process. Upon completion of the digestion reaction, the resulting reaction mixture containing titanium sulfate, iron sulfate and trace elements from the titaniferous bearing material are removed from the reaction vessel and treated to recover a titanium sulfate solution which may be used to prepare titanium compounds or processed according to conventional sulfate processing techniques to prepared titanium dioxide pigment.

Referring to the diagram depicted in FIG. 1, reference numeral 20 represents a reaction vessel. The titaniferous bearing material, for example, MacIntyre ilmenite ore, is feed into reaction vessel 20 from ore storage bin 2. Dilute sulfuric acid having a concentration between about 25% and about 60% by weight, based upon the total weight of the acid solution, is fed either from a mixture of strong acid (96% by weight) from a source 8 of fresh acid and recycle acid (15% to 22% by weight) from source 28 or water from source 10 directly to reaction vessel 20. A reducing material, such as powdered iron, is fed into reaction vessel 20 from reductant storage bin 4. The ilmenite ore and dilute sulfuric acid in reaction vessel 20 are agitated continuously while the temperature is maintained below about 140° C. Agitation is provided by passing a stream of gas and optionally steam as a source of external heat from a source not shown through line 22 into the bottom of reaction vessel 20. The gas streams enters the apex of the cone and rises within agitation column 24. As the gas rises, it expands the slurry in agitation column 24 developing turbulent suspension flow or current. Agitation column 24 directs the flow of the gas bubbles and reaction mixture by providing an upward velocity flow of reaction slurry for its entire length and finally results in dispersing the reaction mixture exiting from the agitation column into the reaction mixture located between the column and inner reaction vessel wall. The arrows in the drawing depict the movement of reaction mixture within the reaction vessel. The reaction mixture is permitted to pass downward between the agitation column and inner reaction vessel wall and once again be passed upward through the agitation column. A sufficient amount of gas is used to insure suspension of titaniferous bearing material in the reaction mixture.

An exhaust vent 6 is provided for venting the agitation gases and any gases, such as hydrogen, generated during the reaction of the titaniferous bearing material and the dilute sulfuric acid.

The reaction mixture is transported from reaction vessel 20 to a separator device 18, in which the unreacted titaniferous bearing material is separated and optionally recycled by way of recycle conduit 14 to reaction vessel 20 or discarded. Alternatively, the reaction mixture is passed to a subsequent reaction vessel through conduit 16 to continue the digestion reaction for extraction of additional titanium values.

Figure 2:
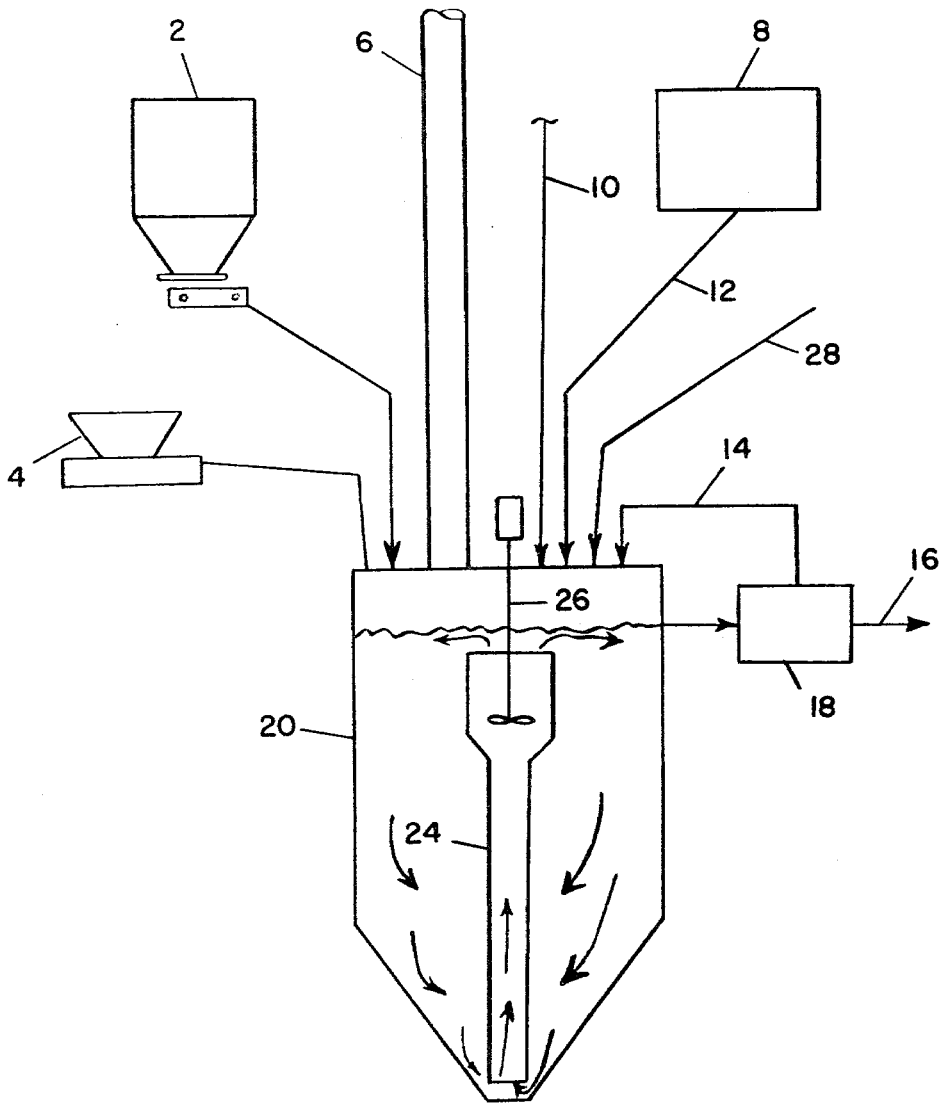
FIG. 2 depicts another embodiment of the process for carrying out the invention wherein a mechanical agitator is employed in an agitation column to provide the desirable degree of extraction.

FIG. 2 depicts a reaction vessel 20 similar to FIG. 1 except the use of a stream of gas through line 22 is replaced with mechanical agitator 26 located at the top of agitation column 24.

The principle and practice of the present invention is illustrated in the following Examples which are exemplary only and it is not intended that the invention be limited thereto since modifications in technique and operation will be apparent to anyone skilled in the art. All parts and percentages specified herein are by weight unless otherwise indicated.

EXAMPLE 1

This example demonstrates the extraction of titanium values from MacIntyre ilmenite ore using the process of the invention with two digestor reactors.

MacIntyre ilmenite ore having a particle size distribution as follows: (U.S. Standard Screen)

| Mesh | Wt. % |
|---|---|
| +100 | 1.2 |
| +200-300 | 35.8 |
| +325-200 | 23.0 |
| +400-325 | 6.0 |
| −400 | 34.0 |

and containing 46.8% $TiO_2$ was continuously fed into a reactor vessel at a rate to provide 100% excess over the stoichiometric amount and reacted with a dilute sulfuric acid solution containing 417% acid by weight which was also fed into the reactor vessel. Powdered iron was added to provide a reductant for the ferric iron content in the reaction mixture.

The reactor had a height to diameter ratio of 2 to 1, and a 60% degree included angle in the bottom conical. The agitation tube extended from the apex of the cone to the top of the reactor and was fitted with holes in the bottom and top to permit entry and exit of the reaction mixture. As the ore and acid were fed into the reactor, 150 scfm (standard cubic feet/minute) of air at a pressure of 30 psig (pounds per square inch gauge) was introduced in the reactor at the apex of the cone to provide an upward turbulent flow. Steam was also fed in along with the air to serve as an internal source of heat.

The second reactor was designed to provide a quiescent method of agitation to assure continued reaction of the previously dispersed reaction mixture and avoid oxidation by entrained air.

The reaction mixture was continuously agitated and maintained at a temperature of 105° C. in the first reactor. Once an initial reaction was achieved, the reaction mixture was continuously withdrawn at a rate to provide about 10 hours residence time and passed to the second reactor.

The reaction mixture was maintained in the second reactor at a temperature of 75° C. and had a residence time of 90 hours.

Analysis of the reaction mixture indicated a 70% conversion in the first stage and a 25% conversion in the second stage with the final reaction solution containing 10.5% soluble titanium (as $TiO_2$), 7.5% free $H_2SO_4$ and 0.5% titanous sulphate (as $TiO_2$).

EXAMPLE 2

This example demonstrates the extraction of titanium values from MacIntyre ilmenite ore using a four-stage reaction system consisting of a first stage reactor equipped with an agitation column overflowing into a free-gas lift agitated second stage which then overflows into an agitated third and fourth reactor. MacIntyre ilmenite ore having a particle size distribution as follows: (U.S. Standard Screen)

| Mesh | Wt. % |
|---|---|
| +100 | 1.2 |
| +200-100 | 35.8 |
| +325-200 | 23.0 |
| +400-325 | 6.0 |
| −400 | 34.0 |

and containing 46.8% $TiO_2$ was continuously fed into the first stage reactor at a rate to provide a 100% excess over the stoichiometric requirement.

The first reactor vessel was equipped with an air feed agitation column having the same design as the first stage reactor described in Example 1. The second stage reactor was of similar design to the first stage, but had no agitation column. The third and fourth stage reactors were of the same design as the second stage reactor described in Example 1. The results are set forth in Table 1 for the amount of titanium extracted as soluble titanium along with the reactor digestion conditions of temperature, residence time, and conversion for each reactor.

TABLE 1

| | Stages | | | |
|---|---|---|---|---|
| Conditions | 1 | 2 | 3 | 4 |
| Temperature (°C.) | 101 | 100 | 85 | 73 |
| Time (hours) | 3.16 | 2.66 | 30 | 30 |
| Total Conversion (%) | 33 | 51 | 84 | 95 |
| % Soluble Titanium (as $TiO_2$) | 5.87 | 7.1 | 9.3 | 9.99 |
| % Free acid | 20.8 | 16.3 | 8.7 | 6.5 |
| Active acid: $TiO_2$ ratio | 4.77 | 3.51 | 2.16 | 1.88 |

The invention being thus described, it will be obvious that the same may be varied in many ways. Such variations are not to be regarded as a departure from the spirit and scope of the invention and all such modifications are intended to be included within the scope of the following claims.

I claim:

1. A process of extracting titanium values from titaniferous bearing material, which comprises:

(1) preparing a reaction mixture containing a titaniferous bearing material in an amount between about 10% and about 400% above the stoichiometric amount of titaniferous bearing material necessary to react with sulfuric acid to provide titanyl sulfate, and a dilute sulfuric acid solution having a concentration between about 25% and about 60% by weight;

(2) maintaining the temperature of the reaction mixture below about 140° C. in the reaction vessel;

(3) extracting the titanium values by circulating the reaction mixture in an agitation column located within the reaction vessel in a direction countercurrent to the flow of the reaction mixture in the annular space located between the agitation column and the inner vessel wall, said circulation being done in a manner to maintain the titaniferous bearing material in a continuous turbulent suspension flow in the agitation column;

(4) cooling the resulting reaction mixture to a temperature below about 110° C. without precipitating the reaction mixture; and (5) discharging the reaction mixture from the reaction vessel and recovering the extracted titanium values.

2. The process in claim 1 wherein agitation is conducted by introducing a stream of gas under pressure into the lower part of the agitation column located within the reaction vessel at a sufficient velocity flow to form a continuously rising turbulent suspension of gas bubbles and reaction mixture, discharging from the upper part of the agitation column the reaction mixture which is then returned to the lower part of the agitation column in the annular space between the agitation column and the inner reaction vessel wall.

3. The process in claim 1 wherein agitation is conducted by an impeller agitator within the agitation column.

4. The process in claim 1 wherein a suitable reductant is added to the reaction mixture to reduce ferric sulfate values to ferrous sulfate, said reductant being added in at least stoichiometric amounts to the quantity of ferric iron present.

5. A continuous process of extracting titanium values from titaniferous bearing material, which comprise:

(1) continuously reacting a titaniferous bearing material in an amount between about 10% and about 400% above the stoichiometric amount of material necessary to react with sulfuric acid to provide titanyl sulphate, and a dilute sulfuric acid solution having a concentration between about 25% and about 60% by weight;

(2) maintaining the reaction mixture at a temperature below about 140° C. in the reaction vessel;

(3) extracting the titanium values by circulating the reaction mixture through an agitation column located within the reaction vessel in a direction countercurrent to the flow of the reaction mixture in the annular space located between the agitation column and the inner reaction vessel wall, said circulation being done in a manner to maintain the titaniferous bearing material in a continuous turbulant suspension flow in the agitation column;

(4) cooling the resulting reaction mixture to a temperature below about 110° C. without precipitating the reaction mixture, and (5) continuously discharging the reaction mixture from the reaction vessel and recovering extracted titanium values.

6. The process in claim 5 wherein the agitation is conducted by introducing a stream of gas under pressure into the lower part of the agitation column located within the reaction vessel at a sufficient velocity flow to form a rising turbulent suspension of gas bubbles and reaction mixture, discharging from the upper part of the agitation column the reaction mixture which is then returned to the lower part of the agitation column in the annular space between the agitation column and the inner reaction vessel wall.

7. The process in claim 5 wherein the agitation is conducted by an impeller agitator within the agitation column.

8. The process in claim 5 where a suitable reductant is added to the reaction mixture to reduce ferric sulfate values to ferrous sulfate, and to reduce minor amounts of titanyl sulfate to titanous sulfate, said reductant being added in at least stoichiometric amounts to the quantity of ferric iron present.

9. A continuous process of extracting titanium values from titaniferous bearing material, which comprises:

(1) reacting titaniferous bearing material in an amount from about 10% to about 400% in excess of the stoichiometric amount of titaniferous bearing material necessary to react with sulfuric acid to provide titanyl sulfate, and dilute sulfuric acid solution having a concentration between about 25% and about 60% by weight, based upon the total weight of said solution, in the presence of a reducing agent which effects the reduction of ferric iron to ferrous iron in a first reaction vessel at a temperature below about 140° C.;

(2) maintaining the reaction until the reaction mixture has a ratio of active acid to titanium dioxide of about 3.0;

(3) extracting the titanium values by agitating the reaction mixture in an agitation column located within the reaction vessel in a direction countercurrent to the flow of the reaction mixture in the annular space located between the agitation column and the inner reaction vessel wall by introducing a stream of gas under pressure into the lower part of the agitation column at a sufficient rate to form a continuously rising turbulent suspension of gas bubbles and reaction mixture through the agitation column, discharging from the upper part of the agitation column the reaction mixture which is then returned to the lower part of the agitation column;

(4) removing the reaction solution from said first reaction vessel and passing it to a second reaction vessel;

(5) continuing the reaction of titaniferous bearing material and dilute sulfuric acid in said second reaction vessel at a temperature below about 110° C. to provide a reaction mixture having a ratio of active acid to titanium dioxide of about 2.0;

(6) separating unreacted titaniferous bearing material from the reaction mixture to provide a solution of iron sulphate and titanyl sulphate;

(7) removing iron sulfate from said solution of iron sulfate and titanyl sulfate to provide a solution of titanyl sulfate;

(8) and recovering the extracted titanium values.

* * * * *